United States Patent [19]

Holvoet et al.

[11] 4,224,588

[45] Sep. 23, 1980

[54] ELECTRIC RELAY HAVING MULTIPLE OPERATIONAL THRESHOLDS

[75] Inventors: Gérard Holvoet; Michel Nicolas, both of Courbevoie, France

[73] Assignee: Orega Circuits et Communication, Paris, France

[21] Appl. No.: 918,265

[22] Filed: Jun. 22, 1978

[30] Foreign Application Priority Data

Jun. 27, 1977 [FR] France ..... 77 19618

[51] Int. Cl.[2] ..... H01H 1/66; H01H 37/32

[52] U.S. Cl. ..... 335/152; 335/208

[58] Field of Search ..... 335/146, 151, 152, 153, 335/154, 202, 208, 5, 112

[56] References Cited

U.S. PATENT DOCUMENTS

| | | | |
|---|---|---|---|
| 3,204,059 | 8/1965 | Saaty | 335/153 |
| 3,283,273 | 11/1966 | Pearse | 335/152 |
| 3,522,562 | 8/1970 | Schon et al. | 335/153 |
| 3,812,441 | 5/1974 | Sakamoto et al. | 335/146 X |

*Primary Examiner*—Fred L. Braun

*Attorney, Agent, or Firm*—Cushman, Darby & Cushman

[57] ABSTRACT

Electric relay comprising flexible-blade switches having multiple operational thresholds. In this relay, the most sensitive switches are within the coil whereas the least sensitive switches are located outside the coil, the magnetic circuit being directed toward the outside switches by the use of magnetic flux detectors. Moreover, the operational thresholds of the switches are adjustable by the use of magnetic shunts disposed in the coil and in the flux detectors, one of the shunts being constituted by a material chosen for its Curie point.

7 Claims, 6 Drawing Figures

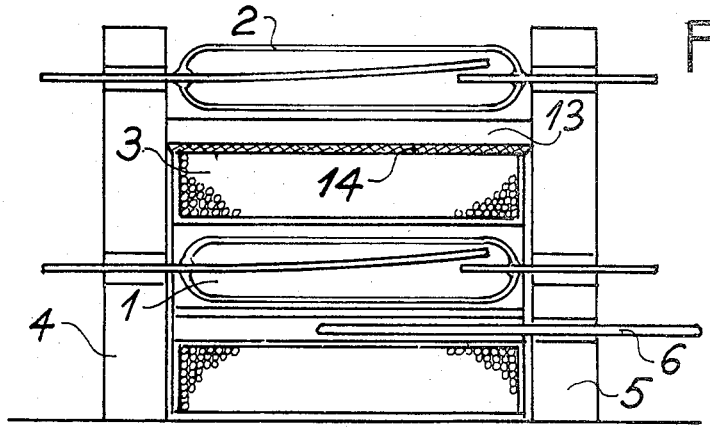
Fig-4
Fig-5
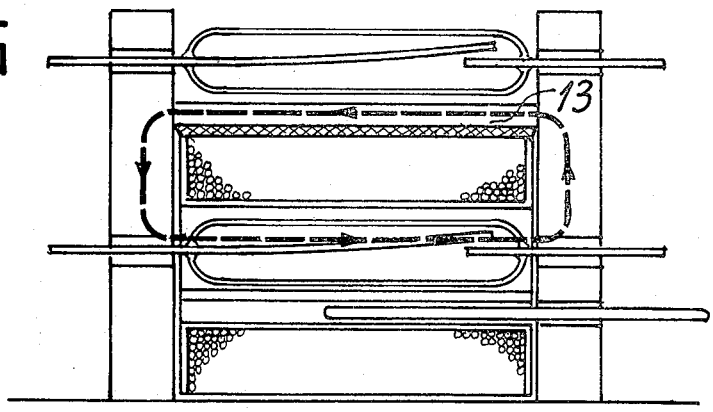
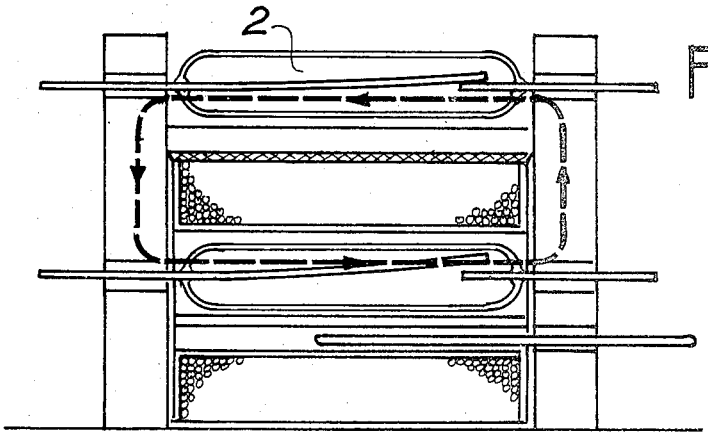
Fig-6

ELECTRIC RELAY HAVING MULTIPLE OPERATIONAL THRESHOLDS

The present invention relates to the field of sealed-contacts electric relays and more particularly to the field of relays sensitive to current magnitudes between or outside current limits which constitute minimum and maximum threshold: the detection of these thresholds is very frequently associated with an action on the source of current which is such that the thresholds are not passed through.

These current thresholds are in particular supervised by, among other existing methods, relays whose coil is traversed by the current to be supervised. The insufficiency or excess of electric current makes the relay change from a stable position to another stable position and thereby acts on the opening or closing of contacts which directly or indirectly control the source of the current to be supervised.

Among the relays employed in practice there are frequently two types: relays having unprotected contacts and relays having sealed contacts. These so-called electromechanical relays operate in the following manner: the magnetic field created by a control coil shifts a ferromagnetic armature which is subjected to an elastically-yieldable return force. The moving armature acts, through suitable transmission means, on one or a plurality of electric contacts. In the case of unprotected-contacts relays, inevitable oxidations and various soiling of the contacts require a high bearing force between the contacts in order to break through or break up the insulating or polluted layer. Unprotected-contacts relays are consequently less sensitive than sealed-contacts relays which are the subject-matter of the present invention.

On the other hand, sealed-contacts relays do not have these drawbacks. They comprise a coil, or an association of coils, which surrounds a bulb of insulating material, at least two electrical contacts, at least one of which is formed by a flexible blade, being sealed in the bulb in such manner that the flexible blade in the course of its displacement either bears against the other contact or moves away therefrom. In certain cases, the flexible blade may occupy two stable positions corresponding to two rigid contacts. This is a more general case of inverting relays which come within the scope of the present invention. The essential of the metal parts, including the parts outside the bulb, is of ferromagnetic material, so that, when an electric current passes through the coil, the resulting magnetic field is closed within the bulb preferentially through the blades. The resulting force which is exerted on the flexible blade shifts it until it is made to have either of two stable positions of its bistable equilibrium. The other stable equilibrium will be obtained by a decrease, below a certain threshold, of the magnetic field which had previously displaced the moving blade.

The aforementioned field to which the blades are subjected may result indifferently from the magnetic field produced by the control coil or the composition of this field with the field of a magnet associated with the switch.

The structure of a sealed-contacts relay permits the insertion of a plurality of bulbs within the coil, provided that room for the bulbs is allowed for in the mandrel on which the coil is wound, which results in relays having a plurality of thresholds of sensibility.

The detection of the different current thresholds is achieved in the prior art by several methods among which may be mentioned, as a nonlimitative example, the use of electromechanical relays and the sealed-contacts relays having multiple bulbs.

Electromechanical relays having different sensitivities are associated in the same circuit through which the current to be supervised passes. But, as mentioned before, electromechanical relays are but little sensitive and above all can only detect currents in extreme ratios having only a small difference. They require a coil of large size in order to create a large magnetic field and the assembly is therefore of large overall size, requires a mechanical adjustment of the sensitivities and is expensive. Further, the moving masses render these mechanical relays slow in operation.

Another solution in the prior art consists in employing a relay having sealed contacts within the coil of which are placed at least two bulbs, the different sensitivities of which are adapted to the thresholds to be detected. This solution combines the advantages related to the use of sealed-contacts relays, namely small size, sensitivity, low thermal resistance which allows accidental current overloads and rapidity of operation. This solution, which is excellent in certain current ranges, however has the drawback of being limited: the allowable differences between the most sensitive and least sensitive of these switches capable of being made on an industrial scale do not exceed in the prior art:

a ratio of 5 to 7 for their actuating excitation;

a ratio of 8 to 12 between the actuating sensitivity of one and the release of the other.

The present invention takes advantage of the fact that the magnetic flux passing through a switch having sealed contacts placed within a coil is much stronger than the magnetic flux passing through a switch located outside said coil. The allowed differences between the most sensitive and the least sensitive of these switches are then increased by those of the two magnitudes of the respectively internal and external magnetic fields.

Further, the use of a magnetic material whose Curie point is specifically chosen (this material being placed between the coil and the external switch and being in thermal connection with the coil), changes the state of the external switch in accordance with the temperature of the coil, that is to say in accordance with the current overload to which the coil is subjected and the corresponding heating of which is added to the ambient temperature surrounding the device.

Therefore, the feature of the present invention is that a low magnetic flux coming from a low current acts on the internal switch whereas a high magnetic flux resulting from a high current which heated the coil, acts on the overload-detecting external switch.

The present invention also encompasses the more general case where a plurality of sealed-contacts switches is located within the coil, and a plurality of switches is located outside the coil. However, in order to simplify the text, the ensuing description relates to the case where there are only two switches, one being inside and the other outside the coil.

A better understanding of the invention will be had from the ensuing description with reference to the accompanying drawings in which:

FIG. 4 represents a relay according to the invention with a magnetic shunt separating the external switch from the coil;

FIG. 5 diagrammatically represents the operation of this relay when a low current passes through the coil;

FIG. 6 diagrammatically represents the operation of this relay when a current high enough to heat the coil passes through the latter.

Figure 1:
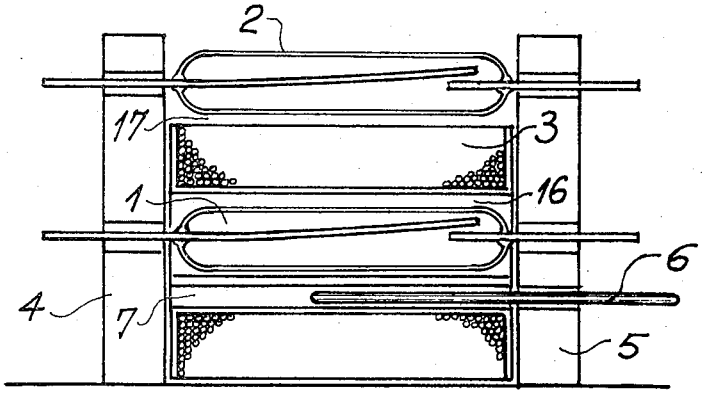
FIG. 1 represents a relay according to the invention.

FIG. 1 shows a relay according to the invention. It comprises a switch 1 having sealed contacts within a bulb placed in the centre 16 of a coil 3. A second switch 2 having sealed contacts in bulb is placed at 17 outside the coil and against the latter. In the absence of any current in the coil, the two switches are in an initial state termed "at rest". When a given current in the coil reaches a sufficient magnitude, it causes the internal switch to pass from the at rest state to the other state of equilibrium termed the "operative" state. A higher current, in producing a higher magnetic field, acts, beyond a certain threshold, on the switch outside the coil which in turn changes from the "at rest" state to the "operative" state. Therefore, advantage is taken of the fact that the low current creates a field at the centre of the coil which acts on the internal switch which behaves as a lower threshold relay, whereas a high current creates in the coil a much higher magnetic field than that which would act on a second switch within the coil and such that its leakage field outside acts on the external switch which behaves as an upper threshold relay.

Figure 2:
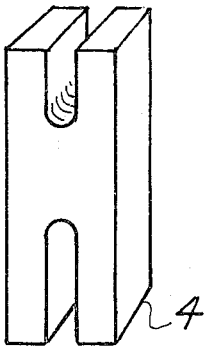
FIG. 2 represents a simple model of a magnetic flux conductive part.
Figure 3:
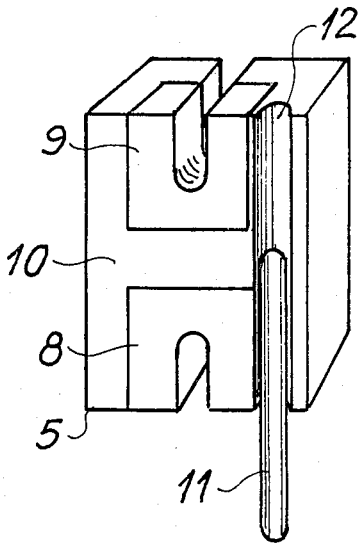
FIG. 3 represents an improved model of the aformentioned magnetic part.

However, another feature of the invention resides in the design of the magnetic circuit which facilitates the adjustment of the thresholds. For this, and contrary to the prior art which does not disclose this type of improvement, the coil carries at each end on a main axis a magnetic flux-conductive ferromagnetic part 4 and 5 which is so designed as to direct this flux preferentially toward the external switch. These ferromagnetic parts are monolithic, as for example that shown in FIG. 2. Each of these parts comprises two passages, namely one for an electrode of the inner switch and the other for an electrode of the external switch. At least one of these ferromagnetic parts is advantageously of a type such as that shown in FIG. 3. As the outer shapes perform no important function, the essential being that two ferromagnetic parts 8 and 9 be rigid with a support 10 which is of a magnetically insulating material, whereas a ferromagnetic bar 11 is free to move in a cavity 12 formed in the insulating support 10 in such a direction that the bar 11, which is slidable therein, can be located in the vicinity of the two parts 8 and 9. Further, the whole of the device comprising the parts 8, 9 and 10 is cut away, like the part previously disclosed in FIG. 2, so as to permit the passage of two electrodes, one of which pertains to the internal switch whereas the other pertains to the external switch.

The two ferromagnetic parts 4 and 5 may be advantageously highly electrically insulating.

Formed in the frame of the coil 3 to be parallel to the main axis is a cavity 7 in which is slidable a ferromagnetic bar 6 whose length is at least equal to the length of the coil.

The sensitivities of the switches, that is to say their operating points, are adjusted in the following manner. The internal switch is adjusted by displacing the ferromagnetic bar 6 in its cavity 7. This bar, which is parallel to the two blades of the internal switch and is located like these blades inside the coil, forms a magnetic shunt for the internal switch. In the absence of the bar, the magnetic flux of the coil passes preferentially through the blades of the internal switch, but if the bar 6 is inserted in its cavity, it forms a magnetic shunt which deviates a part of the magnetic flux: the resulting mechanical force exerted on the flexible blade of the switch is correspondingly reduced and the switch is less sensitive. The operational threshold of the internal switch is consequently determined by the position of the bar 6 in its cavity 7, minimum sensitivity corresponding to the bar fully inserted in its cavity. After a precise positioning, the magnetic shunt is immobilized.

With regard to the external switch, the magnetic leakage flux of the coil is closed onto itself through one of the flux conductive parts, the blades of the external switch and the other flux conductive part. But, as mentioned before, at least one of the two flux conductive parts has advantageously the structure shown in FIG. 3 in which there is an gap between the magnetic parts 8 and 9, this gap being more or less shunted by the magnetic bar 11. In fact, if the magnetic bar 11 is fully inserted in its cavity 12, the parts 8 and 9 are fully shunted and the magnetic flux is maximum, the external switch 2 being then at its maximum sensitivity. The magnetic flux which passes through the external switch decreases in accordance with the position of the magnetic bar 11 in its cavity until it passes through a minimum magnitude if the bar 11 is withdrawn. The external switch has its operational threshold adjusted by determining the corresponding position of the bar 11 in its cavity 12, the maximum sensitivity of the switch being this time obtained, as opposed to the preceding case, when the bar is fully inserted in its cavity.

Note that the adjustment of each of the switches has very little effect on the point of operation of the other, which facilitates each of the adjustments.

According to a given choice of the two switches—the most sensitive within the coil and the least sensitive outside the coil—the currents passing through the coil and resulting in the action of each of the switches are between ratios on the order of 3 to 100, and even more, while retaining the possibility of adjustment of the point of operation of each of the two switches. These figures compare advantageously with those of conventional threshold relays whose corresponding ratios are no better than 5 to 7 as mentioned before.

FIG. 4 shows a modification of the invention whereby it is possible to still further increase the large ratios obtained.

The device according to the invention comprises, like that shown in FIG. 1, two switches 1 and 2, namely one inside the coil 3 and the other outside the latter, two magnetic flux conductive parts 4 and 5 and the adjusting magnetic bar 6 as described before. However, a magnetic shunt 13 is placed between the coil and the external switch. This shunt is in mechanical contact with the two flux conductors 4 and 5 and in thermal contact with the coil 3 through a layer 14 of a material which is thermally stable and a good thermal conductor; it is moreover formed by a material whose Curie point, and consequently whose magnetic permeability, varies suddenly with the temperature. By way of a nonlimitative example, ferrites exist the magnetic permeability of which decreases in the ratio of 100 to 1 when the temperature passes through their Curie point by a few fractions of a degree centigrade. The Curie point of the material forming the shunt 13 is so chosen that it corresponds to the maximum temperature chosen for the coil.

The relay operates in the following manner: when the current passing through the coil increases, it reaches a threshold beyond which it actuates the internal switch, for a magnitude corresponding to the case where the magnetic circuit is completely closed through the shunt 13. The heating of the coil is low in proportion to the current passing through; that of the shunt 13 is also low and the shunt is magnetically permeable. The flux produced by the coil is closed through the shunt and the external switch 2 is subjected only to a very low or negligible magnetic flux.

When the current passing through the coil increases still more, it reaches a magnitude which is such that the resulting heating of the coil brings the shunt 13 to its Curie point. The magnetic permeability of the shunt is considerably reduced thereby in an interval of a few tenths of a degree centigrade. The magnetic flux outside the coil is no longer channeled thereby and passes for a much larger part through the outer switch 2: the outer switch is therefore actuated.

In the course of the cooling of the coil, the thermosensitive shunt 13, which is connected to the coil through a thermal conductor, also cools and its magnetic properties return.

The operation of the relay is diagrammatically illustrated in FIGS. 5 and 6. In FIG. 5, for a low current, the magnetic circuit is closed outside the coil on the dotted line through the shunt, and the external switch is not actuated. In FIG. 6, for a current which is high enough to heat the coil, the shunt, having reached its Curie point, becomes magnetically insulating and the magnetic circuit is closed outside the coil on another dotted line through the external switch which is actuated.

The device according to the invention affords another advantage concerning the response time: in an electromechanical conventional relay, the sensitivity is related to the dimensions of the coil, or more precisely to the number of ampere-turns; the larger the coil the higher is its thermal inertia and the longer the response time.

In contradistinction, in the device according to invention, the response time of the external switch is:

independent of its sensitivity, related to the thermal inertia of the device, and more particularly that of the coil and that of the shunt 13, which is low, and thus results in much shorter response times.

In a practical embodiment of the relay according to invention, provided with a shunt having a Curie point at 80° C., the ratio between the two magnitudes of the control currents, given as a typical order of magnitude, was 100.

What is claimed is:

1. An electric relay having multiple operational thresholds comprising a solenoid in the form of a coil with an inner passage, and two groups of switches each group including at least one switch of the flexible blade type having sealed contacts, said coil connected to a source of electric energy creating magnetic flux within the coil and outside the coil, wherein said two groups of switches are respectively distributed in the magnetic flux existing inside said coil and the magnetic flux existing outside said coil such that the at least one switch in the group of switches inside said coil responds to a different level of current in said coil than the at least one switch in the group of switches distributed outside said coil.

2. A relay as claimed in claim 1, wherein the magnetic flux of the coil is channeled at the ends of said coil by ferromagnetic parts.

3. A relay as claimed in claim 2, wherein said ferromagnetic parts are provided with means for varying said flux existing outside said coil.

4. A relay as claimed in claim 3, wherein said means for varying the flux comprise a magnetic shunt in the form of a bar interconnecting said ferromagnetic parts, said bar being made from a material having two different magnetic permeability magnitudes depending on the temperature and being exposed to the heat energy given off by the solenoid.

5. A relay as claimed in claim 3, wherein said flux varying means comprises two magnetic parts interconnected by a nonmagnetic part, and (2) a movable magnetic bar which interconnects in an adjustable manner the two magnetic parts.

6. A relay as claimed in claim 1, wherein said switches of the type having flexible blades are inverters.

7. A relay as claimed in claim 1, wherein the magnetic flux is produced by a plurality of coils.

* * * * *